US010377590B2

(12) United States Patent
Fujioka et al.

(10) Patent No.: US 10,377,590 B2
(45) **Date of Patent: *Aug. 13, 2019**

(54) IMAGE FORMING APPARATUS

(71) Applicant: Brother Kogyo Kabushiki Kaisha, Nagoya-shi, Aichi-ken (JP)

(72) Inventors: Michio Fujioka, Nagoya (JP); Hiroshi Ichikawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 51 days.

This patent is subject to a terminal disclaimer.

(21) Appl. No.: 15/707,179

(22) Filed: Sep. 18, 2017

(65) Prior Publication Data

US 2018/0079609 A1 Mar. 22, 2018

(30) Foreign Application Priority Data

Sep. 20, 2016 (JP) ..... 2016-183214

(51) Int. Cl.
*B65H 1/12* (2006.01)
*B65H 3/06* (2006.01)
*G03G 15/00* (2006.01)

(52) U.S. Cl.
CPC ..... *B65H 3/0638* (2013.01); *B65H 3/0669* (2013.01); *B65H 3/0684* (2013.01); (Continued)

(58) Field of Classification Search
CPC ... B65H 3/00; B65H 3/02; B65H 3/06; B65H 3/0607; B65H 3/0638; B65H 3/0684; B65H 2407/21; B65H 2601/521; B65H 1/12; B65H 3/0669; G03G 15/6552; G03G 15/6511
See application file for complete search history.

(56) References Cited

U.S. PATENT DOCUMENTS 7,571,905 B2 * 8/2009 Kim ..... B65H 3/0684 271/109
7,798,483 B2 * 9/2010 Oomori ..... B41J 13/103 271/117

(Continued)

FOREIGN PATENT DOCUMENTS

JP 2012-188283 A 10/2012
JP 2015-229540 A 12/2015
JP 2016-011213 A 1/2016

*Primary Examiner* — David H Banh
(74) *Attorney, Agent, or Firm* — Banner & Witcoff, Ltd.

(57) ABSTRACT

An image forming apparatus includes a tray, a roller unit, an image forming unit, and a pressing mechanism. The roller unit includes a feed roller disposed above a downstream end portion of the tray in a sheet conveying direction in which a sheet is conveyed, a separation roller disposed downstream of the feed roller in the sheet conveying direction, and a roller holder pivotable about a rotation axis of the separation roller, the roller holder holding the feed roller rotatably about an axis of the feed roller and pivotably vertically. The pressing mechanism includes an arm member configured to press the roller holder such that the roller holder pivots downward, and a weight portion provided to the arm member and applying, to the arm member, a load in a direction in which the feed roller is raised from the upper surface of the sheet supported on the tray.

9 Claims, 11 Drawing Sheets

(52) U.S. Cl.
CPC ..... *G03G 15/6511* (2013.01); *G03G 15/6552* (2013.01); *B65H 1/12* (2013.01); *B65H 2407/21* (2013.01); *B65H 2601/521* (2013.01)

(56) References Cited

U.S. PATENT DOCUMENTS

| | | | | |
|---|---|---|---|---|
| 8,210,520 | B2 * | 7/2012 | Su | B65H 3/0684 271/109 |
| 8,807,555 | B2 * | 8/2014 | Tsai | B65H 3/0684 271/117 |
| 9,617,091 | B2 | 4/2017 | Matsuo et al. | |
| 10,087,023 | B2 * | 10/2018 | Fujioka | G03G 15/6511 |
| 2003/0026633 | A1 * | 2/2003 | Nakagawa | G03G 15/602 399/367 |
| 2008/0128973 | A1 * | 6/2008 | Hirose | B65H 3/0684 271/117 |
| 2012/0237279 | A1 * | 9/2012 | Ichikawa | B65H 1/04 399/388 |
| 2015/0344245 | A1 | 12/2015 | Matsuo et al. | |
| 2015/0344246 | A1 | 12/2015 | Zensai | |

* cited by examiner

IMAGE FORMING APPARATUS

CROSS-REFERENCE TO RELATED APPLICATION

This application claims priority from Japanese Patent Application No. 2016-183214 filed on Sep. 20, 2016, the content of which is incorporated herein by reference in its entirety.

FIELD OF DISCLOSURE

Aspects of the disclosure relate to an image forming apparatus such as a printer and a copier.

BACKGROUND

A known image forming apparatus includes a sheet feed tray, e.g., a multi-purpose tray or MP tray, an ejection tray, and an image forming unit disposed in a conveyance path extending from the MP tray to the ejection tray. The image forming unit forms an image on a sheet being conveyed from the MP tray toward the ejection tray.

The MP tray is attached to a front of the image forming apparatus to open and close the front of the image forming apparatus. A roller unit is disposed above a sheet-feed opening, which is exposed when the MP tray is open. The roller unit includes a feed roller (or a pickup roller), a separation roller, and a roller holder holding the feed roller and the separation roller rotatably. The roller holder is coupled to an arm which is pivotable. When the arm pivots, the roller unit pivots about an axis coincident with a rotation axis of the separation roller. Pivoting of the roller unit allows the feed roller to move vertically between a first position and a second position higher than the first position. A separation pad contacts the separation roller from behind and above.

Before a sheet is fed, the feed roller is located at the second position and a leading end portion of a sheet supported on the MP tray is located under the feed roller. When the sheet is fed, the feed roller and the separation roller start to rotate. When the feed roller and the separation roller rotate, the arm pivots to allow the roller unit to pivot. When the roller unit pivots, the feed roller lowers from the second position to the first position and then returns from the first position to the second position. In lowering from the second position to the first position, the feed roller, which is rotating, is pressed against the sheet on the MP tray, so that the sheet is fed from the MP tray toward the conveyance path. The fed sheet is singly separated by the separation roller and the separation pad, and is supplied to the conveyance path.

SUMMARY

In the above configuration, however, collision noise may be caused by the feed roller against a sheet every time a sheet is fed. Such collision noise may be caused at the sheet tray as well as at the MP tray.

Illustrative aspects of the disclosure provide an image forming apparatus, which reduces the occurrence of collision noise at the start of sheet feeding.

According to an aspect of the disclosure, an image forming apparatus includes a tray, a roller unit, an image forming apparatus, and a pressing mechanism. The roller unit includes a feed roller, a separation roller, and a roller holder. The feed roller is disposed above a downstream end portion of the tray in a sheet conveying direction in which a sheet is conveyed. The feed roller is configured to rotate in contact with an upper surface of a sheet supported on the tray and feed the sheet from the tray. The separation roller is disposed downstream of the feed roller in the sheet conveying direction and configured to rotate in contact with the upper surface of the sheet fed by the feed roller, separate the sheet singly and feed the sheet to a conveying path. The roller holder is pivotable about a rotation axis of the separation roller. The roller holder holds the feed roller rotatably about an axis of the feed roller and pivotably vertically. The image forming unit is disposed downstream of the tray in the sheet conveying direction and configured to form an image on the sheet conveyed along the conveying path. The pressing mechanism is configured to press the roller unit toward the sheet supported on the tray. The pressing mechanism includes an arm member and a weight portion. The arm member is pivotable about the rotation axis of the separation roller and disposed in contact with the roller holder. The arm member is configured to press the roller holder such that the roller holder pivots downward. The weight portion is provided to the arm member and applies, to the arm member, a load in a direction in which the feed roller is raised from the upper surface of the sheet supported on the tray.

With this structure, the image forming apparatus prevents or reduces collision noise of the feed roller against a sheet and wrinkling at a leading end portion of a sheet.

DETAILED DESCRIPTION

An embodiment of the disclosure will be described with reference to the following drawings.

<Structure of Multi-Function Peripheral>

Figure 1:
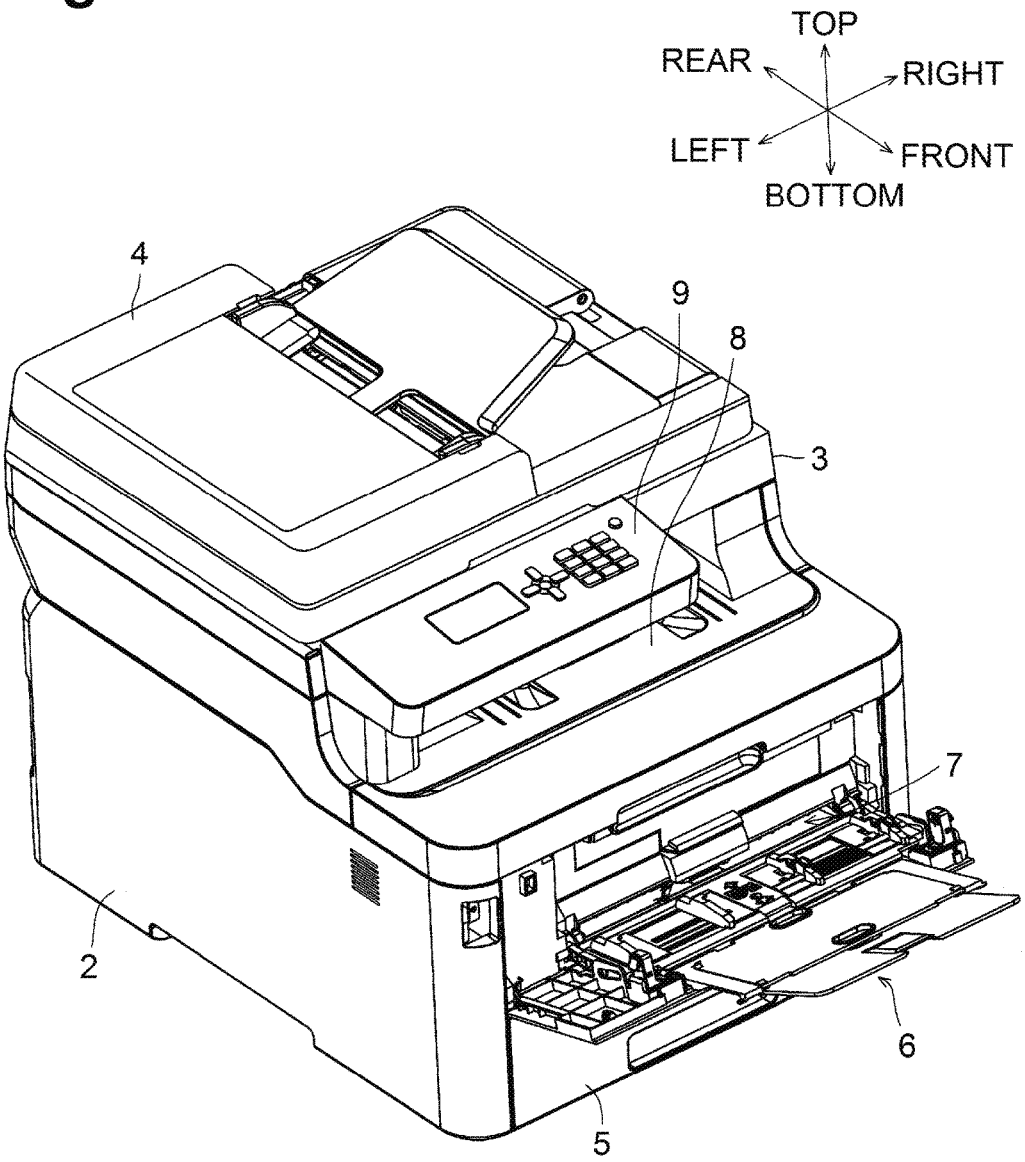
FIG. 1 is a perspective view of a multifunction peripheral (MFP) including a printer according to an illustrative embodiment.

As illustrated in FIG. 1, a multi-function peripheral (MFP) 1 includes a printer 2 as an example of an image forming apparatus, a scanner 3 and an auto document feeder (ADF) 4.

Figure 2:
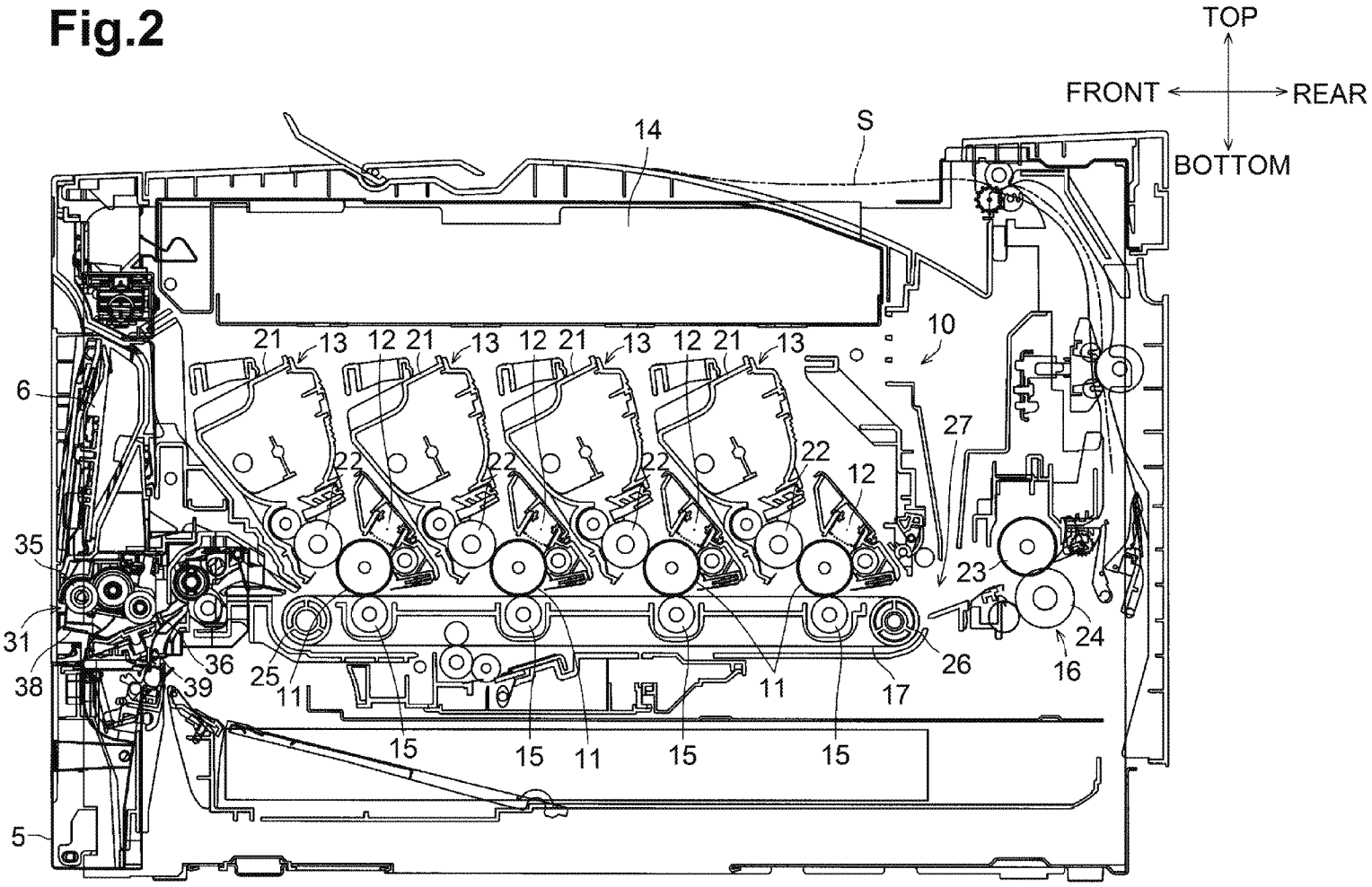
FIG. 2 is a sectional view of the printer.

As illustrated in FIG. 2, a sheet tray 5 is provided in a bottom portion of the printer 2. The sheet tray 5 is configured to support a stack of sheets.

A multi-purpose (MP) tray 6 is disposed at a front of the printer 2. The MP tray 6 is pivotable between a closed position where the MP tray 6 is closed along the front of the printer 2, and an open position where the MP tray 6 is open. The MP tray 6 is capable of supporting a stack of sheets S when it is open. When the MP tray 6 is open, a sheet-feed slot 7 provided at the front of the printer 2 is exposed. The sheet-feed slot 7 is used for feeding a sheet S on the MP tray 6 into the printer 2.

In the following description, a side of the MFP 1 where the MP tray 6 is provided refers to the front or front side, and its opposite side refers to the rear or rear side. The top or upper side, the bottom or lower side, the left or left side, and the right or right side are determined when the MFP 1 is viewed from the front side. In each drawing, the directions are indicated with arrows.

An ejection tray 8 is provided on an upper surface of the printer 2. Sheets supported on the sheet tray 5 or the MP tray 6 are fed one by one and conveyed through the printer 2 toward the ejection tray 8. While a sheet S is conveyed through the printer 2, an image is formed on the sheet S at an image forming unit 10 (FIG. 2) accommodated in the printer 2. The sheet S having the image thereon is ejected to the ejection tray 8.

The image forming unit 10 is of an electrophotographic type in this embodiment. The printer 2 may be provided with another type of image forming unit, such as inkjet type, if it is capable of forming an image (color or monochrome) based on image data on a sheet S.

The scanner 3 is disposed above the printer 2 or spaced upward from an upper surface of the printer 2.

An operation panel 9 is provided at a front end portion of the scanner 3. The operation panel 9 includes a liquid crystal display and an assortment of operation buttons, such as a D-pad for selecting a key to be displayed on the display and a ten-key pad for inputting a number or character.

The ADF 4 is disposed above the scanner 3. Some sheets of documents can be set in the ADF 4. The documents set in the ADF 4 are fed singly and continuously to a contact glass (not shown) provided on an upper surface of the scanner 3 and returned to the ADF 4 after passing on the contact glass. While a document passes on the contact glass, an image of the document is scanned by an image sensor built in the scanner 3 and image data of the scanned image is generated.

<Internal Structure of Printer>

As illustrated in FIG. 2, the image forming unit 10 includes four photosensitive drums 11, four chargers 12, four developing units 13, an exposing unit 14, four transfer rollers 15, and a fixing unit 16. A conveyor belt 17 is disposed in the printer 2.

The four photosensitive drums 11 are evenly spaced apart from one another in a front-rear direction and arranged in the order of colors, black (K), yellow (Y), magenta (M) and cyan (C), from front to rear. Each photosensitive drum 11 is rotatable about an axis extending in a left-right direction or width direction of the printer 2.

Each of the four chargers 12 is disposed diagonally above a corresponding one of the photosensitive drums 11 and is offset to the rear relative thereto. Each charger 12 is a scorotron-type charger including a wire or a grid.

Each of the four developing units 13 is disposed diagonally above a corresponding one of the photosensitive drums 11 and is offset to the front relative thereto. Each developing unit 13 includes a casing 21 and a developing roller 22 held by the casing 21. The developing roller 22 is rotatable about an axis extending in the left-right direction. The peripheral surface of the developing roller 22 is in contact with the peripheral surface of a corresponding photosensitive drum 11.

The exposure unit 14 is disposed above the photosensitive drums 11, the chargers 12, and the developing units 13. The exposure unit 14 includes a laser beam source and an optical system including a polygon mirror, and is configured to irradiate the peripheral surfaces of the respective photosensitive drums 11 with laser beam as modulated based on image data.

The four transfer rollers 15 are disposed below the photosensitive drums 11, respectively. Each transfer roller 15 is rotatable about an axis extending in the width direction.

The fixing unit 16 is disposed behind the rearmost photosensitive drum 11. The fixing unit 16 includes a heat roller 23 and a pressure roller 24. The heat roller 23 is rotatable about an axis extending in the width direction. The pressure roller 24 is disposed below the heat roller 23 and is rotatable about an axis extending in the width direction. The peripheral surface of the heat roller 23 is in contact with the peripheral surface of the pressure roller 24.

The conveyor belt 17 is disposed below the four photosensitive drums 11. The conveyor belt 17 is an endless belt and looped around two rollers 25, 26, which are located at the same position vertically and spaced apart from each other in the front-rear direction. The conveyor belt 17 has upper and lower flat surface portions extending between the two rollers 25, 26 in the front-rear direction and the left-right direction. The upper flat surface portion extends between each of the four photosensitive drums 11 and a corresponding one of the four transfer rollers 15 and is in contact with the peripheral surfaces of the photosensitive drums 11 and the transfer rollers 15.

During printing (image formation) of a sheet S, the photosensitive drums 11 rotate counterclockwise viewed from the right side. FIG. 2 illustrates the image forming unit 10 viewed from the right side. When the photosensitive drums 11 rotate, the surface of each photosensitive drum 11 is uniformly charged by a corresponding charger 12 and then selectively exposed to laser beam from the exposing unit 14. This exposure selectively removes electrostatic charges from the surface of the photosensitive drum 11 to form an electrostatic latent image on the surface of the photosensitive drum 11. A developing bias is applied to the developing rollers 22 of the respective developing units 13. When an electrostatic latent image faces a developing roller 22, toner is supplied from the developing roller 22 to the electrostatic latent image due to a potential difference therebetween. This develops the electrostatic latent image on the surface of the photosensitive drum 11 into a toner image.

A single sheet S is supplied from the sheet tray 5 or the MP tray 6 (FIG. 1) to a conveying path 27 defined in the printer 2. The conveying path 27 is a space continuing from the upper flat surface portion of the conveyor belt 17, via between the heat roller 23 and the pressure roller 24 of the fixing device 16, to the ejection tray 8 (FIG. 1). A sheet S to be conveyed through the conveying path 27 is fed onto the conveyor belt 17. During image formation, the conveyor belt 17 rotates clockwise viewed from the right side. The sheet S fed onto the conveyor belt 17 moves together with the upper flat surface portion of the conveyor belt 17 and passes between each of the photosensitive drums 11 and the conveyor belt 17.

A transfer bias is applied to the transfer rollers 15. When a monochrome image is formed on the sheet S, the black photosensitive drum 11 carries a black toner image on its surface. The black toner image on the surface of the black photosensitive drum 11 is transferred to the sheet S conveyed on the conveyor belt 17 by the influence of the transfer bias. Thus, the monochrome image by the black toner is formed on the sheet S. When a color image is formed on the sheet S, two or more photosensitive drums 11 carry respective different color toner images on their surfaces. The different color toner images are successively transferred and overlaid one above another on the sheet S, which is conveyed by the conveyer belt 17, by the influence of the transfer bias. The toner images overlaid one above another on the sheet S form a color image.

The sheet S having the toner image is conveyed toward the fixing unit 16. In the fixing unit 16, the sheet S passes through between the heat roller 23 and the pressure roller 24. The toner image is fixed on the sheet S by heat and pressure. This completes image formation on the sheet S. The sheet S having the image thereon is ejected to the ejection tray 8 (FIG. 1).

<MP Sheet Feed Mechanism>

The printer 2 includes a multi-purpose (MP) sheet feed mechanism 31 configured to feed a sheet S from the MP tray 6 to the conveying path 27 (FIG. 2). The MP sheet feed mechanism 31 is disposed at a position where it is exposed when the MP tray 6 is open as illustrated in FIG. 1.

Figure 3:
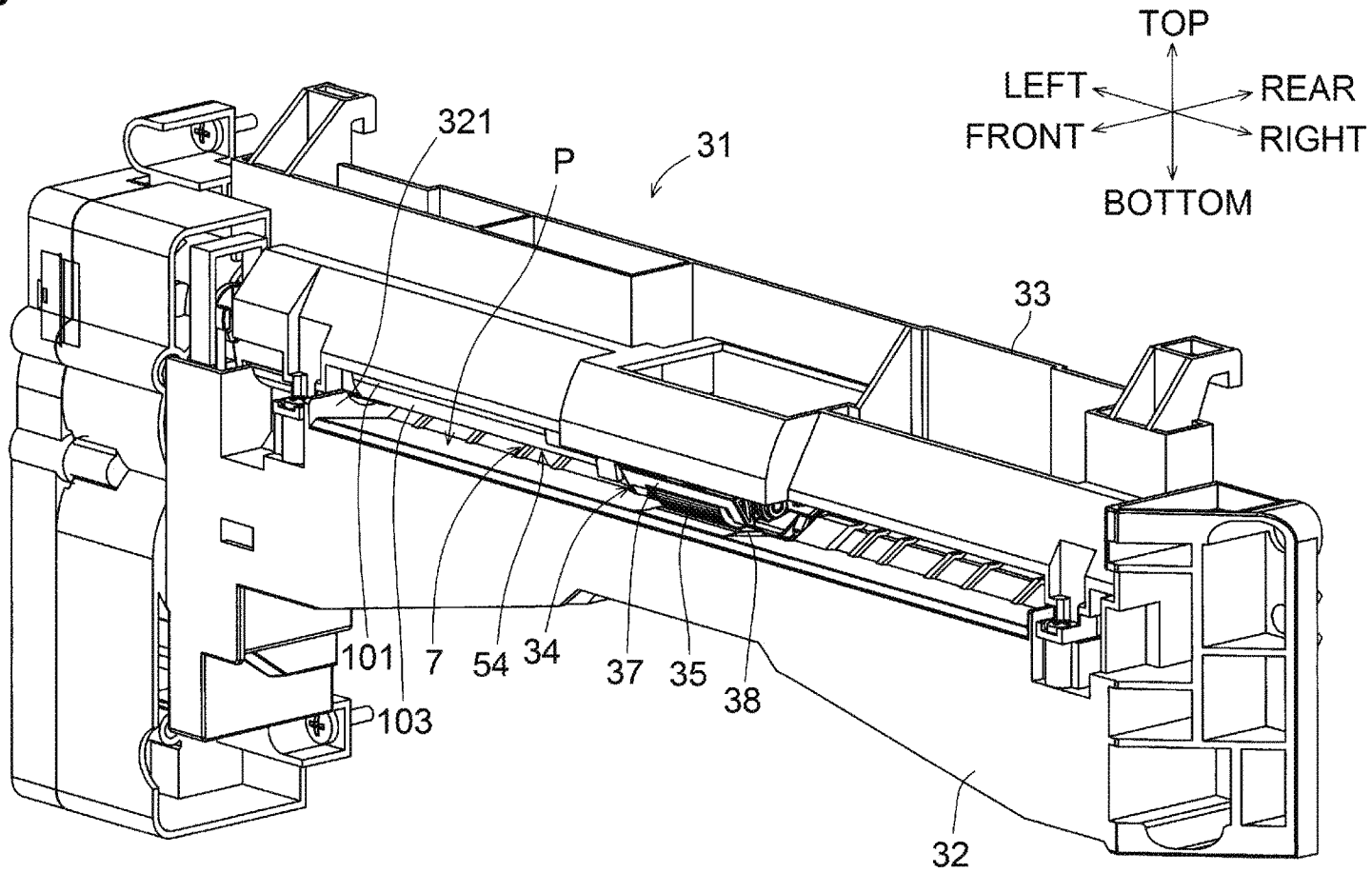
FIG. 3 is a perspective view of a multi-purpose (MP) sheet feed mechanism included in the laser printer.

As illustrated in FIG. 3, the MP sheet feed mechanism 31 includes a lower frame 32 extending in the left-right direction, and an upper frame 33 located above the lower frame 32 and extending in the left-right direction. The lower frame 32 and the upper frame 33 define therebetween a space elongated in the left-right direction. The space forms the sheet-feed slot 7 through which a sheet S is fed from the MP tray 6 toward the conveying path 27.

Figure 4:
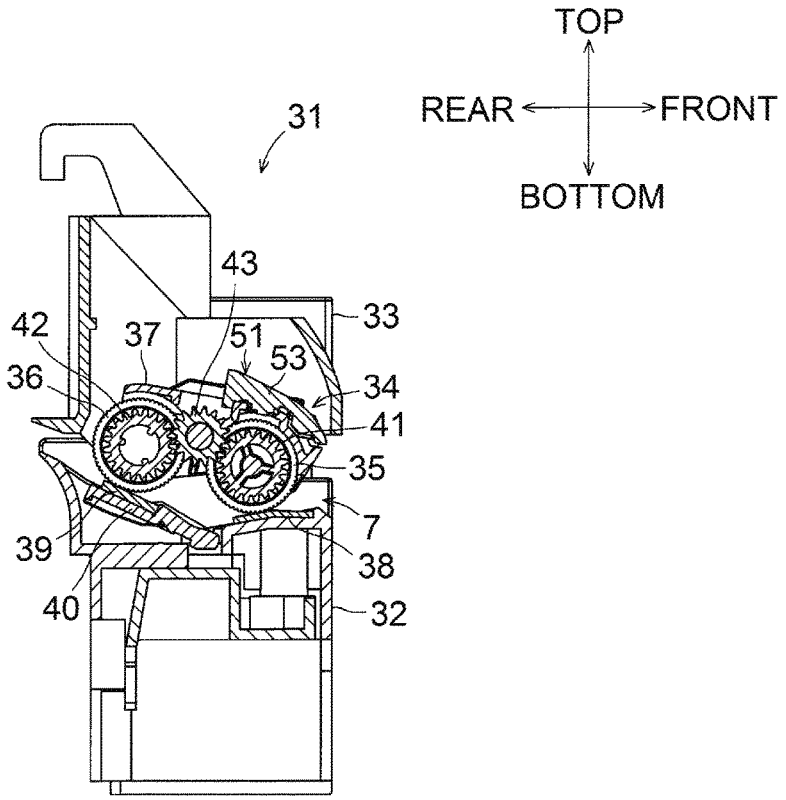
FIG. 4 is a sectional view of the MP sheet feed mechanism.

As illustrated in FIG. 4, a roller unit 34 is disposed between the lower frame 32 and the upper frame 33. The roller unit 34 includes a feed roller 35, a separation roller 36, and a roller holder 37. The feed roller 35 is disposed in front of the separation roller 36. The feed roller 35 and the separation roller 36 are supported by the roller holder 37 rotatably about their respective axes extending in the left-right direction.

A feed-roller pad 38 is disposed in a central portion of a front end portion of an upper surface of the lower frame 32. The front end portion of the upper surface of the lower frame 32 and the MP tray 6 constitute an example of a tray. In this disclosure, the tray is defined as having a surface to support at least a portion of a sheet S thereon. As illustrated in FIG. 3, the front end portion of the upper surface of the lower frame 32 includes a restriction wall 321 extending upward from the upper surface of the lower frame 32 at a position spaced apart from the feed-roller pad 38 to the left. The restriction wall 321 defines a left end of the sheet-feed slot 7. The upper surface of the lower frame 32 located to the right of the restriction wall 321 is a support position P for supporting a sheet S received by both of the upper surface of the lower frame 21 and the MP tray 6. The roller unit 34 is provided such that the feed roller 35 is capable of contacting the feed-roller pad 38 from above.

A separation pad 39 is disposed diagonally below the separation roller 36 and is offset to the rear relative to the separation roller 36. The separation pad 39 is held by the pad holder 40 cantilevered by the lower frame 32. The separation pad 39 is urged by an urging member, not illustrated, such as a coil spring, and thus is elastically in contact with a lower rear portion of the separation roller 36.

The feed roller 35 integrally includes a feed-roller gear 41 at a left end thereof, and the separation roller 36 integrally includes a separation-roller gear 42 at a left end thereof. The roller holder 37 supports an idle gear 43 rotatably. The idle gear 43 engages the feed-roller gear 41 and the separation-roller gear 42.

Figure 5:
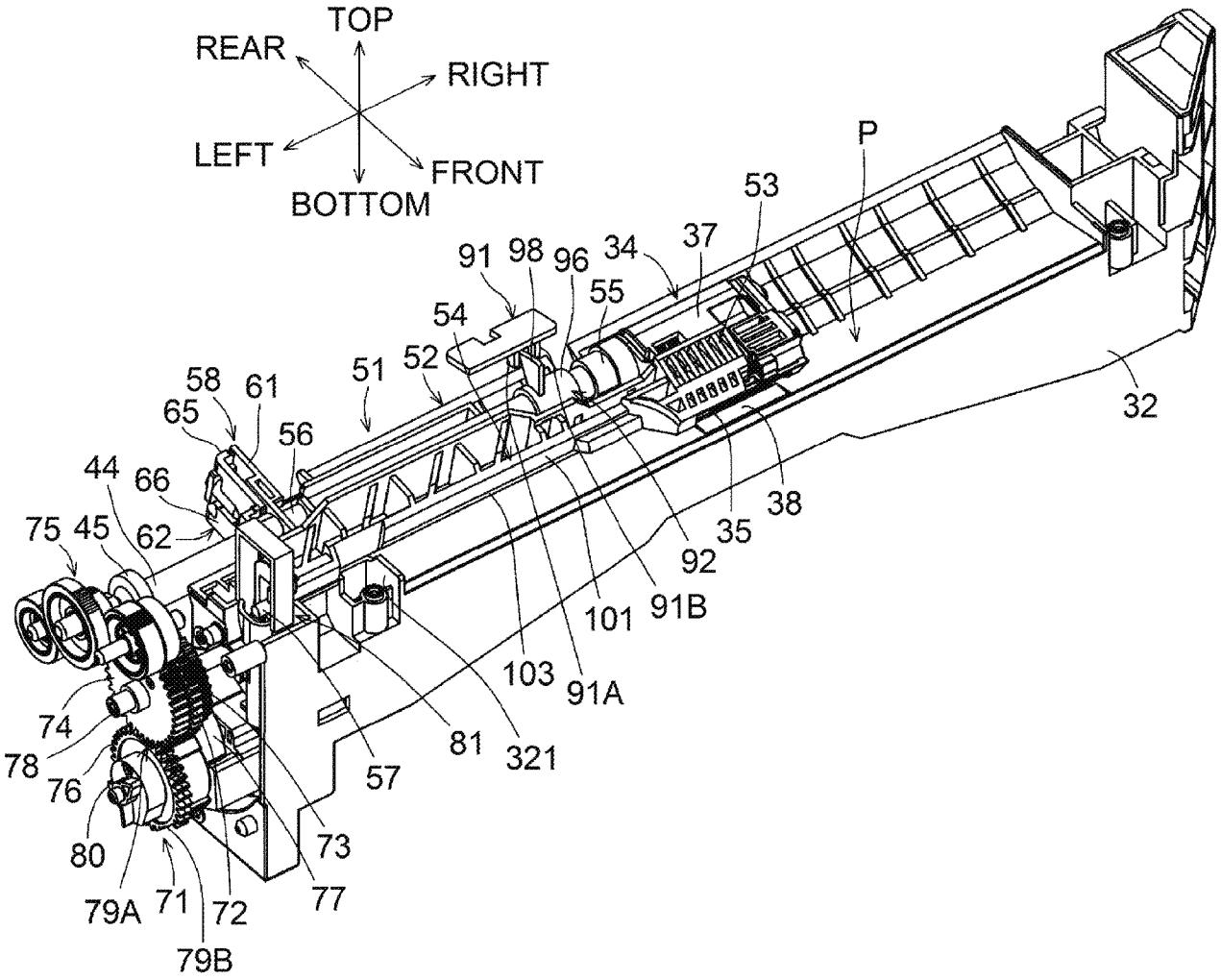
FIG. 5 is a perspective view of a lower frame, a roller unit, a pressing mechanism, and a drive mechanism, which are included in the MP sheet feed mechanism.

A drive shaft 44 illustrated in FIG. 5 extends in the left-right direction and is located to the left of the separation roller 36. The drive shaft 44 is coaxial with the separation roller 36. A right end of the drive shaft 44 is connected to the separation-roller gear 42. A drive gear 45 is fixed at the left end of the drive shaft 44 and coaxial with the drive shaft 44.

The MP sheet feed mechanism 31 includes a pressing mechanism 51. The pressing mechanism 51 is configured to press the roller unit 34 toward the MP tray 6. Specifically, the pressing mechanism 51 is configured to transmit a sheet feed pressure to the roller holder 37 and press the roller holder 37 in a direction where the feed roller 35 is pressed against the feed-roller pad 38 located proximate to the rear end of the MP tray 6. The sheet feed pressure is a force the feed roller 35 presses the sheet.

Figure 6:
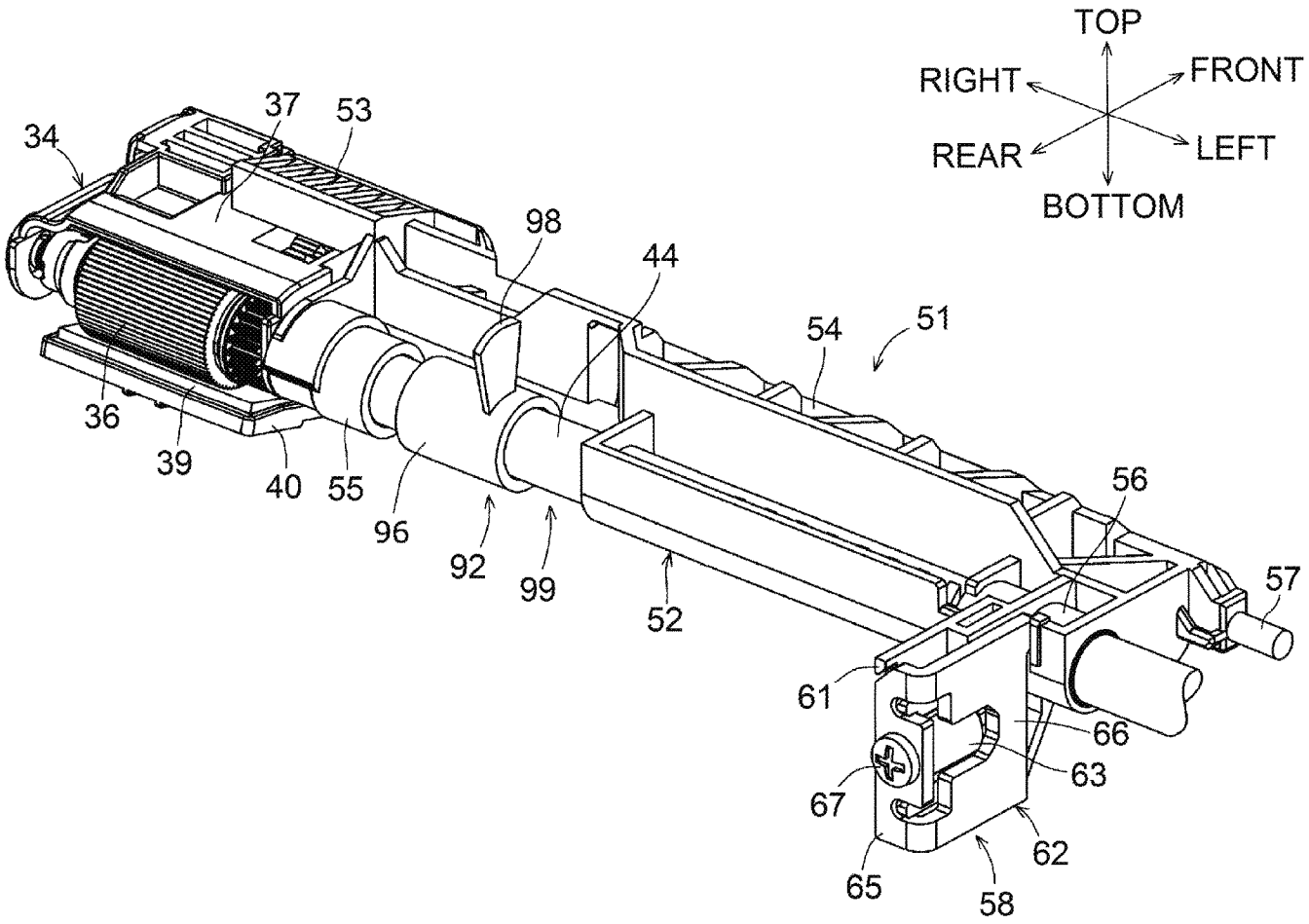
FIG. 6 is a perspective view of the roller unit and the pressing mechanism.

The pressing mechanism 51 includes an arm 52 as an example of an arm member. The arm 52 is made from a black resin. As illustrated in FIG. 6, the arm 52 integrally includes a contact portion 53, an extending portion 54, a first support portion 55, a second support portion 56, and an input portion 57. The contact portion 53 contacts the front end portion of the roller holder 37 from above. The extending portion 54 extends from the contact portion 53 to the left. The first support portion 55 is located at the rear of the right end portion of the extending portion 54. The second support portion 56 is an example of a support portion and is located at the rear of the left end portion of the extending portion 54. The input portion 57 extends from the left end portion of the extending portion 54 to the left.

The contact portion 53 is fixed to the roller holder 37.

The right end portion of the extending portion 54 is bent upward and connected to the contact portion 53.

The first support portion 55 and the second support portion 56 are each shaped like a cylinder having a center line aligned with a rotation axis of the separation roller 36 and an inner diameter corresponding to an outer diameter of the drive shaft 44. The drive shaft 44 is rotatably inserted into the first support portion 55 and the second support portion 56. The first support portion 55 and the second support portion 56 are supported by the drive shaft 44. The arm 52 is pivotably supported by the drive shaft 44. As the contact portion 53 is fixed to the roller holder 37, the roller unit 34 is pivotable about the drive shaft 44 together with the arm 52.

The input portion 57 is shaped like a cylinder. When projected onto a planar surface perpendicular to the left-right direction, the input portion 57 is located within a projection of the feed roller 35.

The pressure mechanism 51 includes a weight portion 58. The weight portion 58 is located to the left relative to the sheet-feed slot 7 (FIG. 3), that is, as illustrated in FIG. 5, to the left further than the restriction wall 321 which defines the left end of the support position P and closer to the exterior than the restriction wall 321 in the left-right direction (or the width direction parallel to a rotation axis of the drive shaft 44). The weight portion 58 includes a weight attachment base 61 integrally formed with the arm 52, and a weight 62 made of metal and shaped like a plate.

As illustrated in FIG. 6, the weight attachment base 61 is located at the same position as the second support portion 56 in the left-right direction, which is parallel to the rotation axis of the drive shaft 44. The weight attachment base 61 protrudes toward the rear from the arm 52 at a position behind the second support portion 56. The weight attachment base 61 has an attachment boss 63 shaped like a cylinder extending in the front-rear direction. The attachment boss 63 has a screw hole 64 (FIG. 8) which is open at the rear end surface thereof.

The weight 62 includes a first piece 65 and a second piece 66. The first piece 65 extends vertically and leanly at the rear of the attachment boss 63. The second piece 66 extends from the left end of the first piece 65 to the front. A metal bolt 67 is inserted into the first piece 65 and screwed into the screw hole 64 of the attachment boss 63. Thereby, the weight 62 is attached to the attachment boss 63 with the first piece 65 in contact with the rear end surface of the attachment boss 63.

Figure 7A:
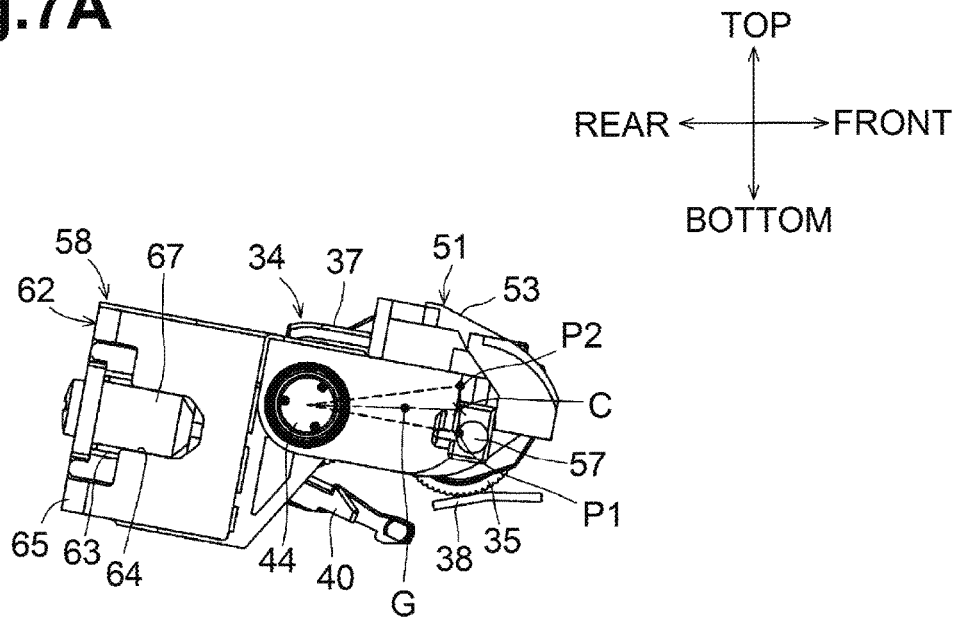
FIG. 7A is a left side view of the roller unit and the pressing mechanism when no sheets are supported on a MP tray.
Figure 7B:
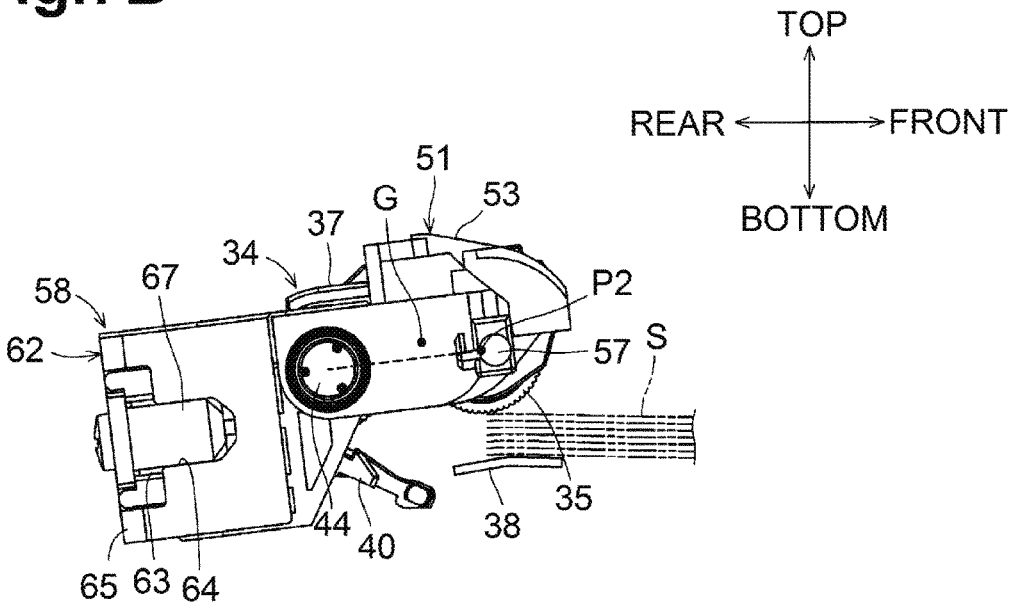
FIG. 7B is a left side view of the roller unit and the pressing mechanism when sheets are maximally supported on the MP tray.

A sheet S or a stack of sheets S is supported on the MP tray 6 such that a leading end portion of the sheet S or the stack of sheets S (or a downstream end portion of the sheet S or the stack of sheets S in a sheet feed direction) is inserted into between the feed roller 35 and the feed-roller pad 38 illustrated in FIGS. 7A and 7B. The feed roller 35 is raised to a height in relation to an amount of sheets S inserted between the feed roller 35 and the feed-roller pad 38. The amount of sheets S corresponds to the number of sheets S. As illustrated in FIG. 7A, when no sheets S are supported on the MP tray 6 and the feed roller 35 is in contact with the feed-roller pad 38, a rotation axis of the feed roller 35 is located at a first position P1. As illustrated in FIG. 7B, when sheets S are maximally supported on the MP tray 6, the rotation axis of the feed roller 35 is located at a second position P2, which is higher than the first position P1. The weight portion 58 is disposed such that the center of gravity G of a pivotable body making up of the roller unit 34, the arm 52 and the weight portion 58 is on a line connecting a center line of the drive shaft 44 (or the rotation axis of the separation roller 36) and a center C between the first position P1 and the second position P2.

As illustrated in FIG. 5, a drive mechanism 71 is disposed to the left of the lower frame 32. The drive mechanism 71 includes, in addition to the drive gear 45, an output gear 72, a change gear 73, an input gear 74, a gear train 75, a sector gear 76, and a cam 77. The output gear 72 engages the drive gear 45. The change gear 73 is rotatable together with the output gear 72. The input gear 74 is coaxial with the output gear 72. The gear train 75 is configured to transmit a drive force from a motor (not illustrated) to the input gear 74. The sector gear 76 is configured to engage the input gear 74. The cam 77 is rotatable together with the sector gear 76.

The output gear 72 is supported via a one-way clutch (not illustrated) by a gear shaft 78, which is rotatable together with the input gear 74.

The sector gear 76 has a first missing teeth section 79A and a second missing teeth section 79B, which are without teeth to engage the input gear 74 and separated from each other in the circumferential direction of the sector gear 76. The sector gear 76 is urged by a helical torsion spring (not illustrated) clockwise viewed from the left side. The sector gear 76 is formed with an engaging portion 80 for engaging a lock pawl (not illustrated) to restrict clockwise rotation of the sector gear 76 viewed from the left side.

Figure 8:
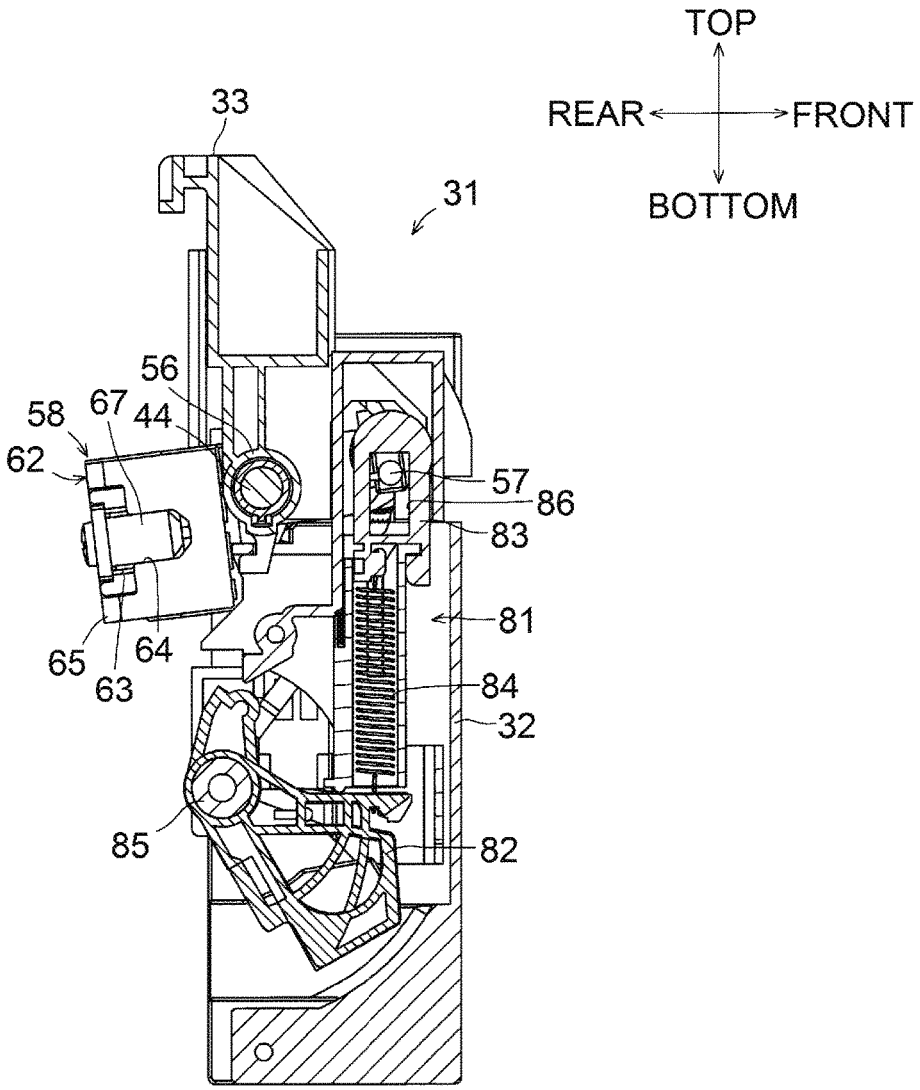
FIG. 8 is a sectional view of a force-generating mechanism included in the drive mechanism.

The drive mechanism 71 includes a force-generating mechanism 81 illustrated in FIG. 8. The force-generating mechanism 81 includes a lever 82, a force-releasing part 83, and a coil spring 84. The lever 82 is configured to contact the peripheral surface of the cam 77. The force-releasing part 83 is held by the lower frame 32 so that it is movable vertically. The coil spring 84 is connected at its lower end to the lever 82 and at its upper end to the force-releasing part 83.

The lower frame 32 is formed with a lever shaft 85 extending in the left-right direction. The lever shaft 85 supports the lever 82 rotatably. The lever 82 is in contact with the peripheral surface of the cam 77 from below. The lever 82 is configured to, during one rotation of the cam 77, reciprocate between a relatively upper position and a relatively lower position.

The force-releasing part 83 has an elongated hole 86, which is long vertically and passes therethrough in the left-right direction. The input portion 57 of the arm 52 is inserted into the elongated hole 86 from the right side.

<Sheet Feeding Operation>

When no sheets S are fed from the MP tray 6, a lock pawl (not illustrated) engages the teeth of the change gear 73. This engagement restricts counterclockwise rotation of the output gear 72 and the change gear 73 viewed from the left side. The lock pawl (not illustrated) engages the engaging portion 80 of the sector gear 76, which in turn restricts clockwise rotation of the sector gear 76 viewed from the left side. The first missing teeth section 79A of the sector gear 76 faces the input gear 74 and thus the sector gear 76 and the input gear 74 disengage.

The lever 82 is located at the upper position and the input portion 57 of the arm 52 is located in the elongated hole 86 of the force-releasing part 83 contactlessly. Thus, the pressing mechanism 51 receives no external force, and the feed roller 35 contacts the feed-roller pad 38 or the upper surface of a sheet S supported on the MP tray 6 under an initial load which is determined by deducting a load due to the weight of the weight portion 58 from a load due to the sum of weight of the roller unit 34 and the arm 52.

When a sheet S is fed from the MP tray 6 to the conveying path 27 (FIG. 2), the drive force from the motor is transmitted via the gear train 75 to the input gear 74, and the input gear 74 rotates counterclockwise viewed from the left side. While the lock pawl engages a tooth of the change gear 73, the input gear 74 rotates but the output gear 74 and the change gear 73 do not rotate. While the first missing teeth section 79A of the sector gear 76 faces the input gear 74, the input gear 74 rotates but the sector gear 76 does not rotate.

After that, the lock pawl disengages the engaging portion 80 of the sector gear 76. The sector gear 76 is urged by the helical torsion spring (not illustrated). When the lock pawl disengages the engaging portion 80 and the restriction of rotation of the sector gear 76 is released, the sector gear 76 rotates clockwise viewed from the left side and starts to engage the input gear 74. The rotation of the input gear 74 is transmitted to the sector gear 76 and thus the sector gear 76 rotates clockwise viewed from the left side.

The cam 77 rotates together with the sector gear 76, which allows the lever 82 to move from the upper position toward the lower position and pull the force-releasing part 83 downward via the coil spring 84. Thus, the force-releasing part 83 moves downward. In the middle of downward movement of the force-releasing part 83, the force-releasing part 83 contacts the input portion 57 of the arm 52, and applies a downward load (sheet feed pressure) to the input portion 57. This load is transmitted from the arm 52 to the roller holder 37. As a result, the roller unit 34 rotates about the drive shaft 44 downward, and the feed roller 35 is pressed against the upper surface of the uppermost sheet S, which is supported on the MP tray 6, with the sum of the initial load and a load (sheet feed pressure) transmitted to the roller holder 37.

The teeth of the change gear 73 and the lock pawl disengage at an appropriate timing. Thus, the change gear 73 is allowed to rotate, the drive force is transmitted to the input gear 74, and the output gear 72 and the change gear 73 rotate clockwise viewed from the left side. The rotation of the output gear 72 is transmitted from the output gear 72 to the drive gear 45, which causes the drive gear 45, the drive shaft 44, and the separation-roller gear 42 to rotate counterclockwise viewed from the left side. When the separation-roller gear 42 rotates, the rotation is transmitted via the idle gear 43 to the feed-roller gear 41, and the feed-roller gear 41 rotates counterclockwise viewed from the left side.

Concurrently with the rotation of the feed roller 35, at least the uppermost sheet S on the MP tray 6 is fed to the rear toward the conveying path 27. When some sheets S are supported on the MP tray 6, the uppermost sheet S and a few subsequent sheets S may be fed together toward the conveying path 27. The fed sheets S are introduced into between the separation roller 36 and the separation pad 39, and only the uppermost sheet S is singly separated from the other sheets S. Thus, the single sheet S passes through between the separation roller 36 and the separation pad 39 and is fed to the conveying path 27.

When the sheet S is fed, the second missing teeth section 79B of the sector gear 76 faces the input gear 74 at a timing that the lever 82 starts to move from the lower position toward the upper position, and thus the engagement of the input gear 74 with the sector gear 76 is released. When the engagement of the input gear 74 with the sector gear 76 is released, the urging force of the coil spring 84 allows the lever 82 to move toward the upper position, which in turn causes the cam 77 to rotate clockwise viewed from the left side. When the cam 77 rotates, the sector gear 76 rotates and engages the input gear 74 again. Rotation of the input gear 74 allows the sector gear 76 to rotate. When the first missing teeth section 79A of the sector gear 76 faces the input gear 74, the engagement of the input gear 74 with the sector gear 76 is released again. The engaging portion 80 of the sector gear 76 contacts and engages the lock pawl, which in turn restricts the rotation of the sector gear 76. Then, the change gear 73 engages the lock pawl again, which in turn restricts the rotation of the output gear 72 and the change gear 73.

This completes the operation for feeding a single sheet S.

<Sheet Detection>

As illustrated in FIGS. 5, 9, 10A and 10B, the printer 2 includes an optical sensor (photo sensor) 91 and an actuator 92, which are for detecting a sheet S to be fed from the MP tray 6 (FIG. 1) to the conveying path 27 (FIG. 2).

As illustrated in FIG. 5, the optical sensor 91 includes element-holding plates 91A, 91B facing each other. The element-holding plates 91A, 91B are provided with a light emitting element for emitting sensor light and a photoreceptor for receiving the sensor light emitted by the light emitting element, respectively. The optical sensor 91 is supported by the upper frame 33 such that the optical sensor 91 is located above and to the left of the roller unit 34 to the rear and that an optical path of the sensor light from the light emitting portion to the photoreceptor extends in the left-right direction, that is, the element-holding plates 91A, 91B face each other in the left-right direction. Thus, the optical sensor 91 is located above a front end portion of the upper surface of the lower frame 32 and overlaps the arm 52 in the left-right direction.

Figure 11:
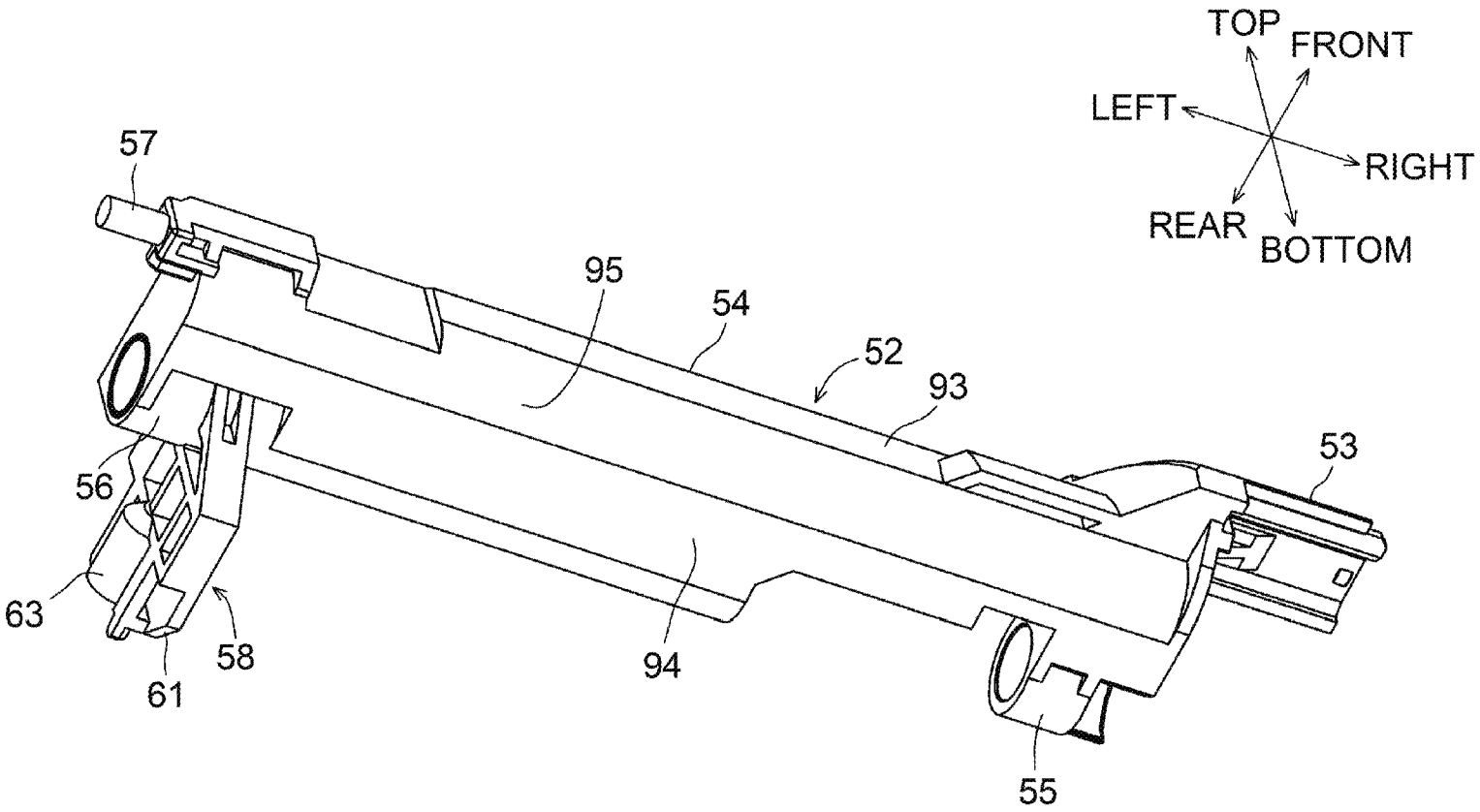
FIG. 11 is a perspective view of an arm included in the pressing mechanism.

As illustrated in FIG. 11, the extending portion 54 of the arm 52 has a front end surface 93 and a lower end surface 94, which are flat surfaces extending in the left-right direction. The front end surface 93 and the lower end surface 94 are connected with a curved surface 95 bulging downward to the front and having an arc-shaped cross section.

Figure 9:
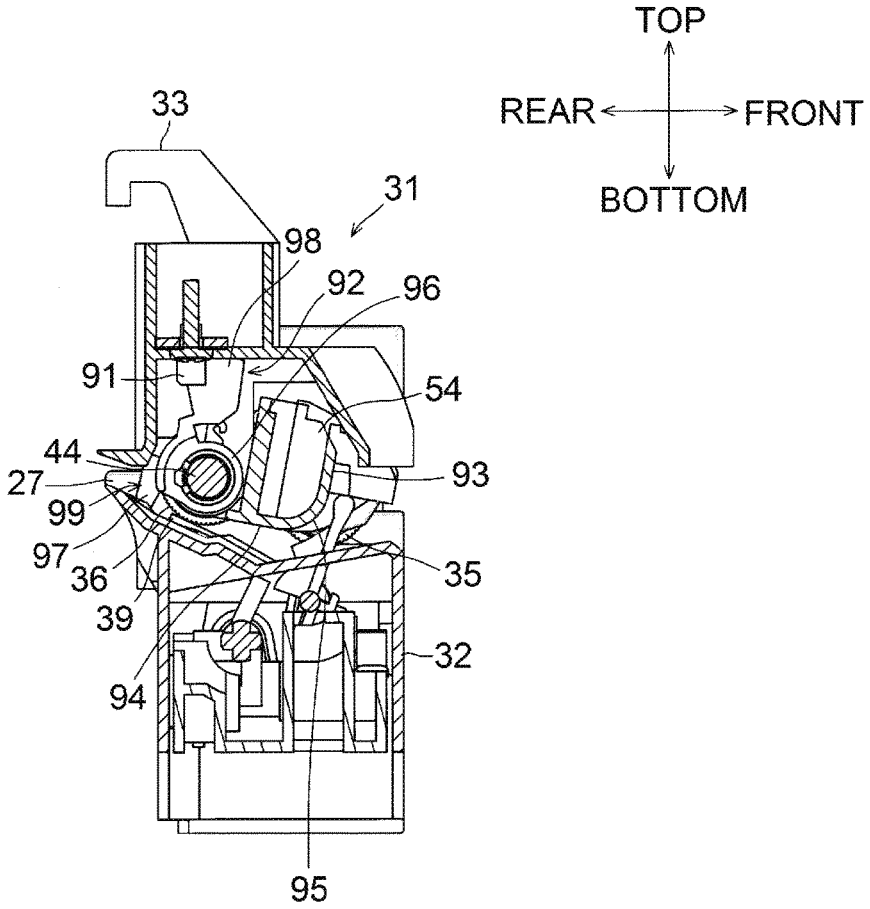
FIG. 9 is a sectional view of the MP sheet feed mechanism at a position of a sensor.
Figure 10A:
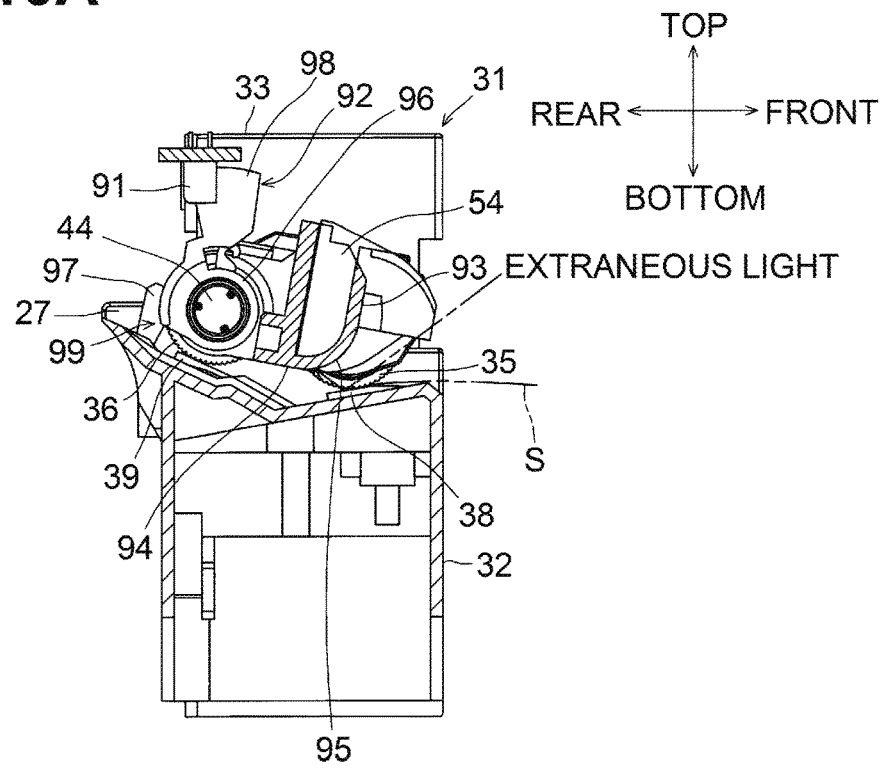
FIG. 10A is a sectional view of the MP sheet feed mechanism when a sheet is not fed.
Figure 10B:
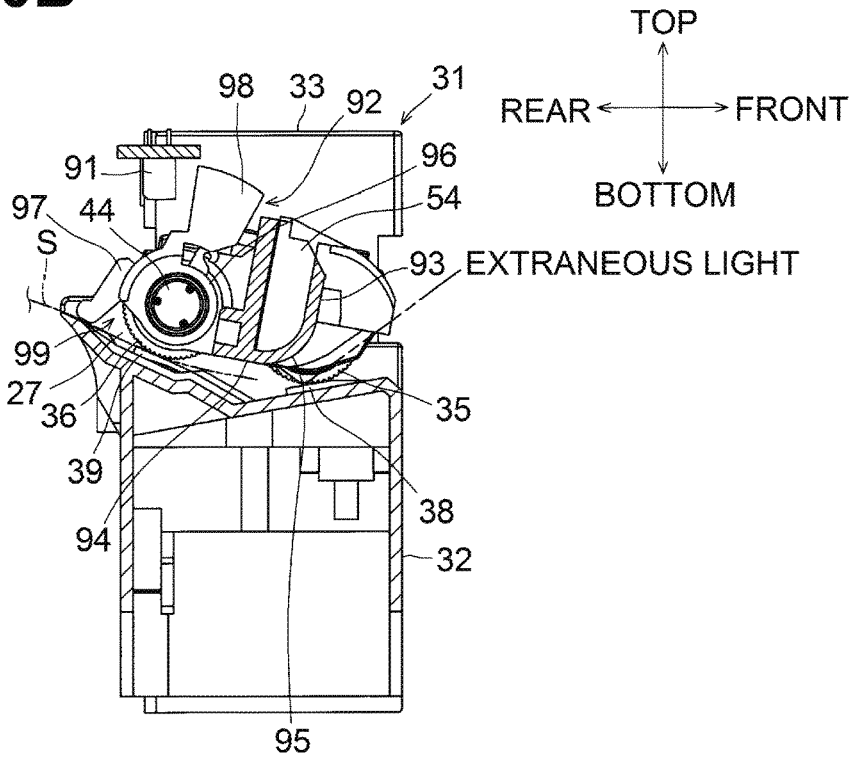
FIG. 10B is a sectional view of the MP sheet feed mechanism when a sheet is fed.

The optical sensor 91 is located above the front end portion of the upper surface of the lower frame 32 and overlaps the arm 52 in the left-right direction. As illustrated in FIGS. 9, 10A, and 10B, the lower end surface 94 is located below the optical sensor 91. The lower end surface 94 extends from proximate to the feed roller 35 toward the separation roller 36. The lower end surface 94 functions as a light shielding surface for shielding extraneous light reflected from the upper surface of the sheet S or the upper surface of the lower frame 32 or the MP tray 6. The lower end surface 94 reduces intrusion of extraneous light indicated by a dash-dot line of FIGS. 10A and 10B into the optical sensor 91. The curved surface 95 functions as a guide surface for guiding individual sheets S from the MP tray 6 toward the conveying path 27.

The feed roller 35 is movable vertically in relation to the number of sheets S supported on the MP tray 6. The vertical movement of the feed roller 35 causes the arm 52 to move vertically (specifically, pivot about the rotation axis of the separation roller 36). Thus, a clearance between the lower end surface 94 and the upper surface of the uppermost sheet S is substantially constant regardless of the number of sheets S supported on the MP tray 6. This prevents intrusion of extraneous light reflected from the upper surface of the sheet S from the optical sensor 91 regardless of the number of sheets S supported on the MP tray 6, which in turn prevents false detection (or output of false signal) of the optical sensor 91.

The actuator 92 integrally includes a support portion 96, a contact portion 97, and a light-shielding portion 98.

The support portion 96 is cylindrically shaped and fitted around the drive shaft 44 such that the support portion 96 is rotatable relative to the drive shaft 44.

The lower end surface 94 of the arm 52 is formed with a cutout 99, which is cut out from the rear toward the front and located at a position overlapping the optical sensor 91 in the left-right direction, that is, located to the left of the first support portion 55. The contact portion 97 extends from the support portion 96 in a radial direction of the drive shaft 44 through the cutout 99 to the conveying path 27.

The light shielding portion 98 is located at the same positon as the optical sensor 91 in the left-right direction, and extends upward from the support portion 96.

The actuator 92 is pivotable, when a sheet S passes, between a light-blocking position illustrated in FIG. 10A and a non-light-blocking position illustrated in FIG. 10B.

In other words, when a sheet S does not contact the actuator 92, the actuator 92 is located at the light-blocking position. As illustrated in FIG. 10A, the contact portion 97 vertically intersects the conveying path 27, and the light shielding portion 98 is located on the optical path of the light emitted from the optical sensor 91. Thus, the optical path of the optical sensor 91 is interrupted by the light shielding portion 98 and the optical sensor 91 outputs an off signal (a low-level signal).

When a sheet S is fed from the MP tray 6, the leading end of the sheet S contacts the contact portion 97 of the actuator 92. The sheet S being conveyed presses the contact portion 97 rearward, and the actuator 92 pivots clockwise viewed from the left side. In pivoting, the actuator 92 moves from the light-blocking position to the non-light-blocking position illustrated in FIG. 10B, where the light shielding portion 98 of the actuator 92 moves toward the front and deviates from the optical path of the optical sensor 91. As the optical path of the optical sensor 91 is not interrupted by the light shielding portion 98, the optical sensor 91 outputs an on signal (a high-level signal).

While the sheet S contacts the contact portion 97 of the actuator 92, the actuator 92 is located at the non-light-blocking position and the optical sensor 91 continues to output the on signal.

When the trailing end of the sheet S (or the upstream end of the sheet S in the sheet feed direction) is separated from the contact portion 97 of the actuator 92, the actuator 92 moves from the non-light-blocking position and returns to the light-blocking position due to an urging force of a wire spring, which is not illustrated. When the actuator 92 returns to the light-blocking position, the optical path of the optical sensor 91 is interrupted by the light shielding portion 98 of the actuator 92, and the signal outputted from the optical sensor 91 varies from the on signal to the off signal.

Thus, the sheet S about to be conveyed to the conveying path 27 can be detected based on a variation in signal outputted from the optical sensor 91.

The optical sensor 91 may output an on signal (a high-level signal) when the optical path of the sensor light from the light emitting portion to the photoreceptor is interrupted and may output an off signal (a low-level signal) when the optical path is not interrupted.

<Operational Advantage>

As described above, the roller unit 34 feeds a sheet S from the MP tray 6 to the conveying path 27 and the image forming unit 10 forms an image on the sheet S conveyed along the conveying path 27.

The roller unit 34 includes the feed roller 35, the separation roller 36, and the roller holder 37. The feed roller 35 is disposed above the end portion of the MP tray 6 proximate to the conveying path 27, and is configured to rotate in contact with the upper surface of a sheet S supported on the MP tray 6 to feed the sheet S from the MP tray 6. The separation roller 36 is configured to rotate in contact with the upper surface of the sheet S fed by the feed roller 35 to separate the sheet S singly and feed the sheet S to the conveying path 27. The roller holder 37 is pivotable about the rotation axis of the separation roller 36 and holds the feed roller 35 rotatably about its axis and pivotably vertically.

The pressing mechanism 51 includes the arm 52 and the drive mechanism 71. The arm 52 is pivotable about the rotation axis of the separation roller 36. The drive mechanism 71 is configured to apply, to the arm 52, a load in a direction in which the arm 52 presses the feed roller 35 against the upper surface of the sheet S. The arm 52 is in contact with the roller holder 37 and is configured to press the roller holder 37 such that the roller holder 37 pivots downward. Thus, the arm 52 applies a load to the roller holder 37, and the roller holder 37 applies a load due to its own weight and the load received from the arm 52 to the feed roller 35. The feed roller 35 is in contact with the upper surface of a sheet S to be fed, under a load due to its own weight in addition to the load received from the roller holder 37. As the feed roller 35 is in contact with the sheet S before the start of sheet feeding, there is little likelihood that the feed roller 35 collides with the sheet S, which reduces the occurrence of collision noise.

When a sheet S is supported on the MP tray 6, a leading end portion of the sheet S is inserted under the feed roller 35 along the upper surface of the MP tray 6 and the feed roller 35 is raised by the leading end portion of the sheet S. If a sheet S is not stiff, the feed roller 35 may not be raised well and a wrinkle may occur at the leading end portion of the sheet S.

The arm 52 is provided with the weight portion 58. The weight portion 58 applies, to the arm 52, a load in a direction in which the arm 52 raises the feed roller 35 from the upper surface of a sheet S. Due to the arm 52 including the weight portion 58, the feed roller 35 can be raised by the leading end portion of a sheet S, which may be of low bending stiffness, when the sheet S is inserted under the feed roller 35. Thus, inconvenience such as a wrinkle at the leading end portion of the sheet S can be reduced.

The weight portion 58 is located to the left relative to the sheet-feed slot 7. That is, the weight portion 58 is located to the left relative to the support position P where a sheet S to be fed is supported. Thus, the weight portion 58 is out of the way of placing a sheet S on the MP tray 6.

The weight portion 58 is located downstream of the separation roller 36 in a sheet conveying direction in which a sheet S is conveyed. Thus, the weight portion 58 is out of the way of placing a sheet S on the MP tray 6.

The feed roller 35 is located at the first position P1 (illustrated in FIG. 7A) when no sheets S are supported on the MP tray 6, and at the second position P2 (illustrated in FIG. 7B), which is higher than the first position P1, when sheets S are maximally supported on the MP tray 6. The weight portion 58 is disposed such that the center of gravity G of the pivotable body making up of the roller unit 34, the arm 52 and the weight portion 58 is located between the rotation axis of the separation roller 36 and the center C, which is located between the first position P1 and the second position P2. This arrangement reduces variations in position of the center of gravity G of the pivotable body, and thus facilitates setting of the weight of the weight portion 58 for raising the feed roller 35 by a leading end portion of a sheet S when inserted under the feed roller 35.

The arm 52 includes the second support portion 56 in which the drive shaft 44 coupled to the separation roller 36 is fitted. The second support portion 56 is supported by the second support portion 56. The weight portion 58 is located at the same position as the second support portion 56 in the left-right direction. This positional relationship can reduce the arm 52 from being twisted due to the weight portion 58.

The weight portion 58 includes the weight 62 made of metal and shaped like a plate. The load the weight portion 58 applies to the arm 52 can be easily adjusted by making the weight 62 heavy or light.

<Modifications>

While the illustrative embodiment of the disclosure has been described, the disclosure will be applicable to other embodiments.

The above embodiment shows but is not limited to the printer 2 included in the MFP 1. The printer 2 may operate on a standalone basis.

Illustrative embodiments described above are merely examples. Various changes, arrangements and modifications may be applied therein without departing from the spirit and scope of the disclosure.

What is claimed is:

1. An image forming apparatus comprising:

a tray;

a roller unit including:

a feed roller disposed above a downstream end portion of the tray in a sheet conveying direction in which a sheet is conveyed, the feed roller being configured to rotate in contact with an upper surface of a sheet supported on the tray and feed the sheet from the tray;

a separation roller disposed downstream of the feed roller in the sheet conveying direction and configured to rotate in contact with the upper surface of the sheet fed by the feed roller, separate the sheet singly and feed the sheet to a conveying path; and a roller holder pivotable about a rotation axis of the separation roller, the roller holder holding the feed roller rotatably about an axis of the feed roller and pivotably vertically;

an image forming unit disposed downstream of the tray in the sheet conveying direction and configured to form an image on the sheet conveyed along the conveying path; and a pressing mechanism configured to press the roller unit toward the sheet supported on the tray, the pressing mechanism including:

an arm member pivotable about the rotation axis of the separation roller and disposed in contact with the roller holder, the arm member being configured to press the roller holder such that the roller holder pivots downward; and a weight portion provided to the arm member and applying, to the arm member, a load in a direction in which the feed roller is raised from the upper surface of the sheet supported on the tray.

2. The image forming apparatus according to claim 1, wherein the pressing mechanism further includes a drive mechanism configured to apply, to the arm member, a load in a direction in which the arm member presses the feed roller against the upper surface of the sheet supported on the tray.

3. The image forming apparatus according to claim 1, wherein the tray includes a restriction wall extending upward from the downstream end portion of the tray, and wherein the weight portion is located closer to an exterior of the image forming apparatus than the restriction wall of the tray in a width direction parallel to the rotation axis of the separation roller.

4. The image forming apparatus according to claim 1, wherein the weight portion is located downstream of the separation roller in the sheet conveying direction.

5. The image forming apparatus according to claim 1, wherein the feed roller is located at a first position when no sheets are supported on the tray and at a second position, which is higher than the first position, when sheets are supported on the tray, and wherein the weight portion is disposed such that a center of gravity of a pivotable body is located between the rotation axis of the separation roller and a center defined between the first position and the second position when no sheets are supported, the pivotable body including the roller unit, the arm member and the weight portion.

6. The image forming apparatus according to claim 1, wherein the arm member includes a support portion in which a drive shaft coupled to the separation roller is fitted, the support portion being supported by the drive shaft, and wherein the weight portion is located at the same position as the support portion in a width direction parallel to the rotation axis of the separation roller.

7. The image forming apparatus according to claim 1, wherein the weight portion includes a weight made of metal and shaped like a plate.

8. The image forming apparatus according to claim 1, wherein the arm member is in contact with an upper portion of the roller holder closer to the feed roller than the rotation axis of the separation roller, the arm member being configured to press the roller holder such that the roller holder pivots downward.

9. An image forming apparatus comprising:

a tray;

a feed roller disposed above an end portion of the tray and configured to rotate in contact with an upper surface of a sheet supported on the tray and feed the sheet from the tray;

a separation roller disposed downstream of the feed roller in a sheet conveying direction in which a sheet is conveyed and configured to rotate in contact with the upper surface of the sheet, separate the sheet singly and feed the sheet to a conveying path located downstream of the tray in the sheet conveying direction;

a roller holder pivotable about a rotation axis of the separation roller, the roller holder holding the feed roller rotatably about an axis of the feed roller and pivotably vertically;

an arm member pivotable about the rotation axis of the separation roller, the arm member being disposed in contact with the roller holder and configured to press the roller holder such that the roller holder pivots downward;

a weight portion provided to the arm member and applying, to the arm member, a load in a direction in which the feed roller is raised from the upper surface of the sheet supported on the tray; and a drive mechanism configured to apply, to the arm member, a load in a direction in which the feed roller is pressed against the upper surface of the sheet supported on the tray.

* * * * *